US006975213B2

(12) United States Patent
Wang

(10) Patent No.: US 6,975,213 B2
(45) Date of Patent: Dec. 13, 2005

(54) WHISTLE WITH LIGHT EMITTING DEVICE

(76) Inventor: Lo-Pin Wang, 16F-2, No. 17, Lane 52, Sec. 3, Re He Rd., Taichung (TW)

( * ) Notice: Subject to any disclaimer, the term of this patent is extended or adjusted under 35 U.S.C. 154(b) by 14 days.

(21) Appl. No.: 10/671,486

(22) Filed: Sep. 29, 2003

(65) Prior Publication Data

US 2005/0068158 A1 Mar. 31, 2005

(51) Int. Cl.[7] ..... G08B 3/00
(52) U.S. Cl. ..... 340/328; 340/329; 340/330; 340/326; 446/204; 446/47; 116/137 R
(58) Field of Search ..... 340/328, 329, 340/330, 331, 321, 326; 446/204, 47, 202, 446/176; 116/137 R

(56) References Cited

U.S. PATENT DOCUMENTS

| | | | | |
|---|---|---|---|---|
| 4,314,316 | A * | 2/1982 | Gertler et al. | 362/86 |
| 4,739,990 | A * | 4/1988 | Aguirre et al. | 463/47.3 |
| 5,329,872 | A * | 7/1994 | Wright | 116/137 R |
| 5,816,186 | A * | 10/1998 | Shepherd | 116/137 R |
| 5,897,457 | A * | 4/1999 | Mackovjak | 482/8 |
| 6,181,236 | B1 * | 1/2001 | Schneider, Jr. | 340/326 |
| 6,329,927 | B1 * | 12/2001 | Hobson | 340/815.69 |

* cited by examiner

*Primary Examiner*—Jeffery Hofsass
*Assistant Examiner*—Daniel Previl
(74) *Attorney, Agent, or Firm*—Bacon & Thomas, PLLC

(57) ABSTRACT

A whistle has a whistle member having a mouthpiece at a front thereof, a chamber therein, a passage communicated with the chamber, and an outlet at a sidewall of the chamber, and a light emitting device provided on the whistle member, which has a lamp, a battery and a switch device, wherein the lamp is conducted with the battery and the switch is provided at between the lamp and the battery to turn the lamp on or off.

6 Claims, 2 Drawing Sheets

WHISTLE WITH LIGHT EMITTING DEVICE

BACKGROUND OF THE INVENTION

1. Field of the Invention

The present invention relates to a whistle, and more particularly to a whistle with a light emitting device.

2. Description of the Related Art

Women or children usually carry devices for self-defense such as a whistle, sun gun or pepper gas spray and so on. All of them have the function of defense or call for help. The stun gun and the pepper gas spray themselves are dangerous for children. The whistle is the most popular device for both women and children to call for help or to scare the bad guy off during an emergency. However, the conventional whistle only has the function of making noise and might not keep him or her from danger since someone who hears the noise of the whistle might have a problem to identify the location in a dark place.

SUMMARY OF THE INVENTION

The primary objective of the present invention is to provide a whistle, which has functions of making noise and emitting light while he/she is in danger.

According to the objective of the present invention, a whistle comprises a whistle member having a mouthpiece at a front thereof, a chamber therein, a passage in communication with the chamber, and an outlet at a sidewall of the chamber, and a light emitting device provided on the whistle member, which has a lamp, a battery and a switch device, wherein the lamp is electrically connected with the battery and the switch is provided between the lamp and the battery to turn the lamp on or off.

DETAILED DESCRIPTION OF THE INVENTION

Figure 1:
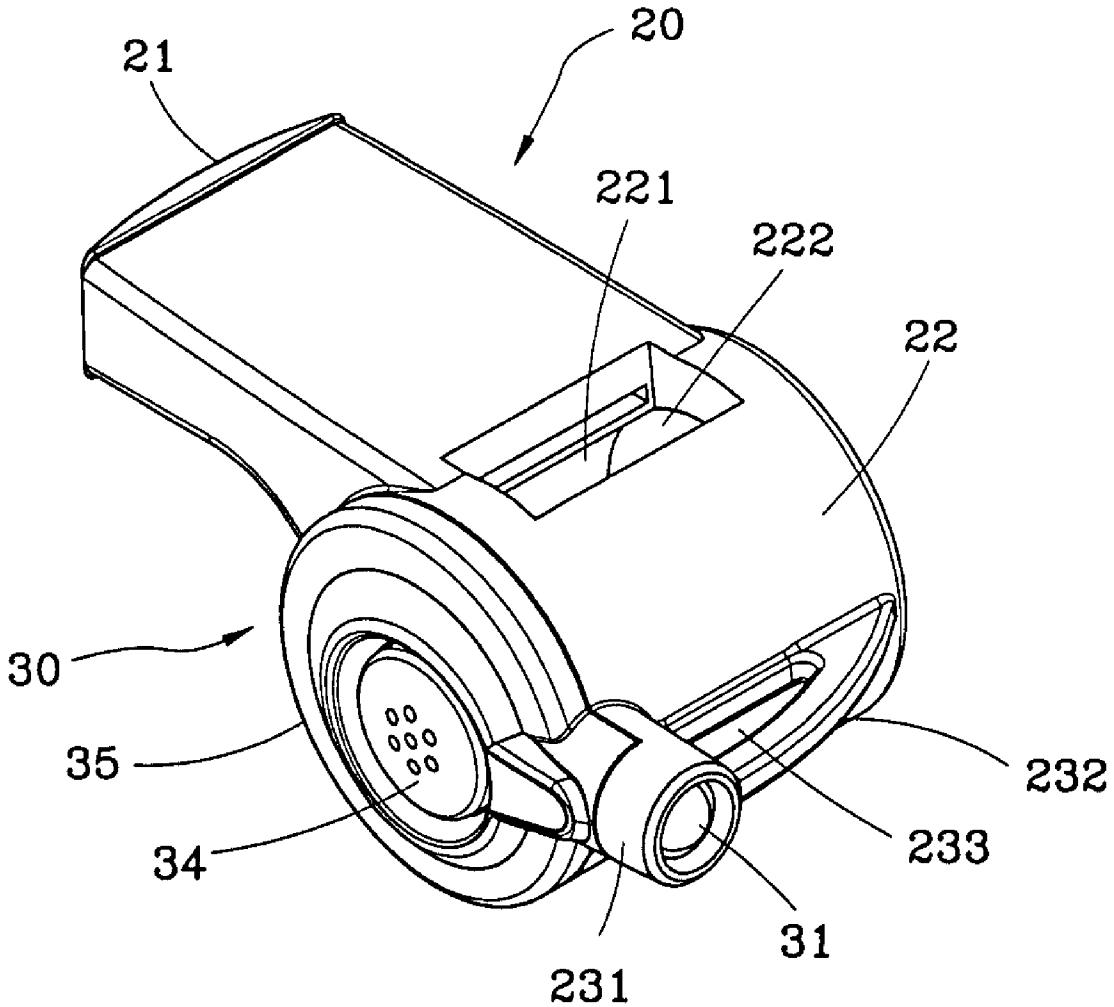
FIG. 1 is a perspective view of a preferred embodiment of the present invention.
Figure 2:
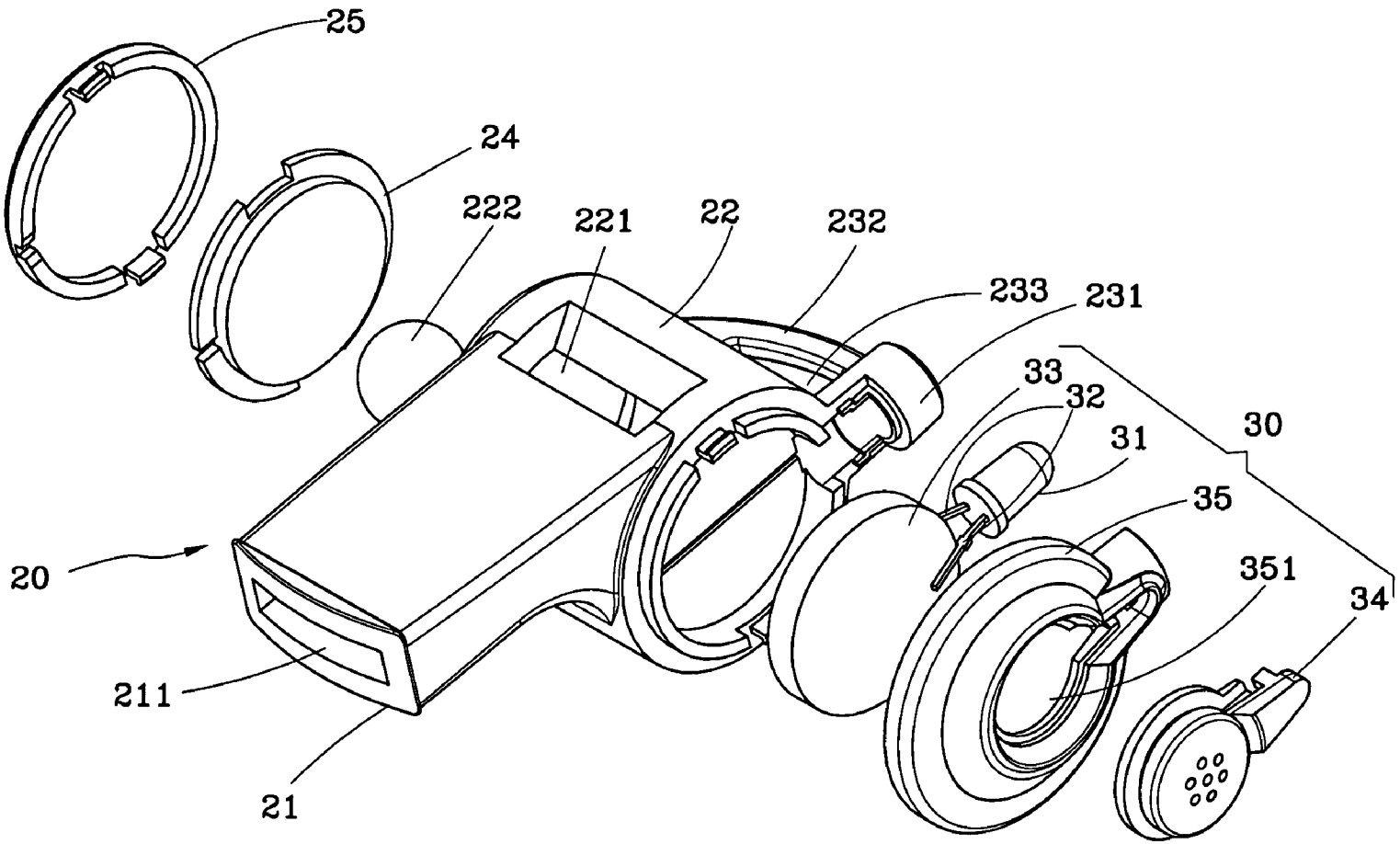
FIG. 2 is an exploded view of the preferred embodiment of the present invention.

As shown in FIG. 1 and FIG. 2, a whistle 20 of the preferred embodiment of the present invention comprises:

A whistle member 20 has a mouthpiece 21 at a front thereof, a chamber 22 therein, a passage 211 in the mouthpiece 21 that communicates with the chamber 22, and an outlet 221 on a sidewall of the chamber 22 and a ball 222 received in the chamber 22. The chamber 22 is open at opposite lateral sides and at the left opening of which is an annular rib at a periphery thereof to form a recess 23 therewithin. A tube 231 is provided on the whistle member 20 having an end in communication with the recess 23. The whistle member 20 is provided with a hanger 232 at a rear thereof, wherein the hanger 232 has opposite ends connected with the rear of the whistle member 20 and the tube 231. Between the hanger 232 and the whistle member 20 is an opening for tying a rope (not shown). A round board 24 wi provided at the right opening of the chamber 22 to seal it and a cover 25 is detachably provided on the board 24. Between the board 24 and the cover 25 is a space in which small goods may be stored.

A light emitting device 30 has a lamp 31, which is a light emitting diode (LED) in the present invention, to be received in the tube 231 and a battery 32 received in the recess 23 wherein the battery 32 is arranged between two terminals of the LED lamp 31. The LED lamp 31 has one terminal that contacts an anode terminal of the battery 32. The other terminal initially does not contact the cathode terminal of the battery 32. A cover 35 is detachably provided on the whistle member 20 to cover the battery 32 and parts of the LED lamp 31. The cover 35 has an aperture 351 at a center thereof. A switch device 34 is provided to turn the LED lamp 31 on or to turn it off. In the present preferred embodiment, the switch device 34 is a button provided in the aperture 351 of the cover 35. The button 34 is pivoted on the cover 35 to cause the terminal of the LED lamp 31 to touch the battery 32. There are many conventional alternate devices of the switch device 34 and they should be within the scope of the invention.

The button 34 is pressed to bend the terminal of the LED lamp 31 to make the terminal touch the cathode terminal for the battery 32 such that the LED lamp 31 lights. When the button 34 is no longer pressed, the terminal of the battery 32 recovers and pushes the button 34 outwards. Under such condition, the terminal of the battery 32 does not touch the battery 32 and the LED lamp 31 does not light.

The whistle of the present invention serves the function of providing bot noise and light emission when the user needs held. The light might scare the bad guy off and enable other people to more easily find the location of the user in a dark place. The light emitting device 30 of the whistle of the present invention also can light the key hole and some other places that need to be lighted.

The types of the whistle and the lamp are not limited to those shown in the perspective view of the drawings. They may be replaced with any suitable type of whistle and lamp, such as a whistle of high tone to broadcast the noise further and a lamp of high luminous intensity. Such a whistle of the present invention is suitable for the climber calling for help on a mountain.

What is claimed is:

1. A whistle, comprising;

a whistle member having a mouthpiece at a front thereof, a chamber therein, a passage in communication with the chamber, and an outlet at a sidewall of the chamber, and a light emitting device provided on the whistle member, the light emitting device having a lamp, a battery and a switch device, wherein the lamp is electrically connected with the battery and the switch is provided between the lamp and the battery to turn the lamp on or off, wherein a recess is provided at a lateral side of the whistle, a battery is received in the recess, the lamp includes first and second terminals and is provided in a tube having an end in communication with the recess so that the first terminal of the lamp directly contacts the battery, a cover is detachably provided on the whistle member to cover the battery and parts of the lamp, the cover has an aperture at a center of the cover, and the switch device is a button provided in the aperture, the button being arranged to cause the second terminal to directly contact the battery and switch on the lamp.

2. The whistle as defined in claim 1, wherein the lamp is a light emitting diode.

3. The whistle as defined in claim 1, further comprising a ball received in the chamber of the whistle member.

4. The whistle as defined in claim 1, wherein the whistle member is detachably provided with a second cover and between the second cover and the whistle member is a space for storing small goods.

5. The whistle as defined in claim 1, wherein the chamber of the whistle member is open at a lateral side thereof and a board is provided on the whistle member to seal the chamber, a second cover is detachably provided on the whistle member covering the board, and between the board and the second cover is a space for storing small goods.

6. The whistle as defined in claim 1, wherein the whistle member has a hanger, which has an end thereof connected with the whistle member and the other end thereof connected with the tube.

* * * * *